US006846599B2

(12) United States Patent
Ide

(10) Patent No.: US 6,846,599 B2
(45) Date of Patent: Jan. 25, 2005

(54) IMAGE STRUCTURE AND IMAGE-FORMING SYSTEM

(75) Inventor: Osamu Ide, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 146 days.

(21) Appl. No.: 10/373,728

(22) Filed: Feb. 27, 2003

(65) Prior Publication Data

US 2004/0086694 A1 May 6, 2004

(30) Foreign Application Priority Data

Jun. 5, 2002 (JP) ..... P.2002-164872

(51) Int. Cl.[7] ..... G03C 3/00

(52) U.S. Cl. ..... 430/9; 430/18; 399/15; 399/31

(58) Field of Search ..... 430/9, 18; 399/15, 399/31

(56) References Cited

FOREIGN PATENT DOCUMENTS

JP 04-242752 8/1992

OTHER PUBLICATIONS

Keiji Ohbayashi, "Color Paper For Inkjet Recording", Central Research Institute, Konica Company, Japan.

"About Ink Jet Recording Color Paper", Keiji Obayashi (the Society for the Study of Advanced Hard Copy Technology, the 57$^{th}$ Regular Meeting Documents, Japan Technology Transfer Association (JTTAS), Mar. 23, 1999.

"Specular Glossiness—Methods of Measurement" JIS Z 8741, Japanese Industrial Standard., Sep. 1997.

*Primary Examiner*—Mark A. Chapman
(74) *Attorney, Agent, or Firm*—Morgan, Lewis & Bockius LLP

(57) ABSTRACT

An image structure formed on a medium. The image structure is so formed that an angular distribution of surface reflection light beams under the condition that a surface of an image G formed on a medium is irradiated with a slit-transmitted light beam satisfies the following three characteristics: (1) an angle A corresponding to a half value of a reflected light peak is not smaller than unity but not larger than twice as large as a reference angle A0; (2) the ratio $\Delta X_G WS/\Delta X_G WS0$ of the value of WS of center-of-gravity fluctuation to the value of reference WS0 of center-of-gravity fluctuation is not larger than 10; and (3) an angle B at which the quantity of reflected light becomes 1/10 as large as the peak value is in a range of from 3×A0 to 6×A0, both inclusively.

14 Claims, 10 Drawing Sheets

FIG. 11

| | CHARACTERISTIC VALUE | | | SENSUAL EVALUATION | OTHERS |
|---|---|---|---|---|---|
| | (1) | (2) | (3) | | |
| EXAMPLE 1 | 1.2 | 4.2 | 4.1 | ○ | |
| EXAMPLE 2 | 1.1 | 3.0 | 3.5 | ○ | |
| EXAMPLE 3 | 1.5 | 7.2 | 3.2 | ○ | |
| COMPARATIVE EXAMPLE 1 | 1.0 | 3.8 | 2.2 | × | CONSPICUOUS FLAWS |
| COMPARATIVE EXAMPLE 2 | 1.4 | 12.5 | 4.9 | ×× | CONSPICUOUS WAVINESS |
| COMPARATIVE EXAMPLE 3 | 4.0 | 18.0 | 7.2 | × | ROUGH SURFACE |
| COMPARATIVE EXAMPLE 4 | 4.2 | 17.3 | 5.9 | × | CONSPICUOUS FLAWS |
| COMPARATIVE EXAMPLE 5 | 4.3 | 15.8 | 6.5 | × | CONSPICUOUS FLAWS |
| COMPARATIVE EXAMPLE 6 | 1.6 | 15.3 | 4.5 | ×× | CONSPICUOUS WAVINESS |
| COMPARATIVE EXAMPLE 7 | 1.2 | 7.7 | 2.5 | × | APPARARENT AIR BUBBLES |

IMAGE STRUCTURE AND IMAGE-FORMING SYSTEM

BACKGROUND OF THE INVENTION

1. Field of the Invention

The present invention relates to an image structure and an image-forming system for forming the image structure. Particularly, it relates to an image structure capable of giving a preferable surface for a photographic print such as a digital photographic print preferable in surface quality, and improvement in an image-forming system for forming the image structure.

2. Background Art

To obtain a preferable digital photographic print, appearance of an image surface, that is, reproduction of surface quality is very important as well as image qualities such as reproduction of colors, gradations, granularity, and resolution. Surface quality largely depends on slight waviness, small dents, protrusions or the like present in the image surface.

Increase in quality of an image formed by an image-forming system such as an ink jet system has been developed in recent years. For example, as described in the data "About Ink Jet Recording Color Paper", Keiji Obayashi (the Society for the Study of Advanced Hard Copy Technology, the $57^{th}$ Regular Meeting Documents, JAPAN TECHNOLOGY TRANSFER ASSOCIATION (JTTAS)), various inventions concerning a method and apparatus particularly aiming at reproduction of photographic surface quality mainly for paper have been proposed.

SUMMARY OF THE INVENTION

In these ink jet technologies, there are however various problems in expensiveness of paper, poor durability and conspicuousness of flaws in the case of void layer-containing paper such as silica-coated paper, ink bleeding and poor water resistance in the case of hydrophilic polymer-coated paper, and so on.

For example, as described in the data "About Photographic Printing Paper Support", Tetsuro Fuchizawa (the Society for the Study of Advanced Hard Copy Technology, the $57^{th}$ Regular Meeting Documents, JAPAN TECHNOLOGY TRANSFER ASSOCIATION (JTTAS)), in the case of silver halide photographic printing, there are a lot of problems in difficulty of producing a smooth surface because of an undesirable influence of a medium structure remaining in a surface structure, necessity of providing an expensive resin coat layer to improve the difficulty of producing the surface smoothness, increase in size of a silver halide photographic image-forming system, use of a solvent in the silver halide photographic image-forming system, adhesiveness of an image surface wet with water, and so on.

An apparatus and method of laminating a transparent resin film on an original image produced once by an ink jet printing method, silver halide photography, electrophotography or the like to thereby provide a smooth surface may be proposed. In this case, there are however problems in waviness of the image surface due to the roughness of the original image surface, inclusion of air bubbles in between the transparent resin film and the original image, increase in thickness and cost of the transparent resin film, and so on.

Evaluation of surface quality depending on the surface structure is important for producing a more preferable image. For example, in practice, various indicators such as average surface gloss have been evaluated.

On the other hand, for direct evaluation of surface structure, surface roughness has been evaluated by use of a contact or non-contact surface roughness meter or a laser interferometer.

It is however impossible to achieve a preferable surface quality even in the case where gloss or surface roughness is controlled.

The invention is developed to solve the technical problems and an object of the invention is to provide an image structure of a strong and durable digital photographic printing image or the like which is smooth in surface structure, free from waviness and preferable in surface quality and which contains no air bubble of a size apparently detected as a defect, and to provide an image-forming system for forming the image structure easily.

That is, as shown in FIG. 1A, the invention provides an image structure which is formed so that an angular distribution of surface reflection light beams under the condition that a surface of an image G formed on a medium 1 is irradiated with a slit-transmitted light beam B satisfies three characteristics (1) to (3) as follows:

(1) an angle A corresponding to a half value of a reflected light peak is not smaller than unity but not larger than twice as large as an angle A0 corresponding to a half value of a reflected light peak of surface reflection light beams under the condition that a surface of a gloss standard glass plate (Gloss 96.8, made by MURAKAMI COLOR RESEARCH LABORATORY) is irradiated with a slit-transmitted light beam;

(2) $\Delta X_G WS/\Delta X_G WS\mathbf{0}$ is not larger than 10 when $\Delta X_G WS$ is an integrated value (WS of center-of-gravity fluctuation) after the X coordinate $X_G$ for the center of gravity in each Y position is calculated in an X-Y coordinate system having an X axis in a direction corresponding to the slit width and a Y axis in a direction perpendicular to the former and is multiplied by a frequency response function of vision on the basis of frequency analysis of a locus of the X coordinate $X_G$ of the center of gravity in the Y direction, and $\Delta X_G WS\mathbf{0}$ is a reference value obtained by calculation of WS of center-of-gravity fluctuation of the gloss standard glass plate (Gloss 96.8, made by MURAKAMI COLOR RESEARCH LABORATORY) in the same manner as described above; and (3) an angle B at which the quantity of reflected light becomes 1/10 as large as the peak value is in a range of from 3×A0 to 6×A0, both inclusively.

In the technical means, the image G is mainly a photographic image such as a digital photographic printing image but is not limited to an electrophotographic image (an image formed by electrophotography). The concept "image G" widely includes an electrostatic recording image (an image formed by an electrostatic recording method), an ink jet image, a silver halide photographic image, and so on.

In the invention, a subject of the image structure is an image which can be formed on the medium 1. Accordingly, surface characteristic of the medium 1 should not be separately considered from the image structure but be considered together with the image structure so that the surface characteristic of the medium 1 together with the image G are required to satisfy the optical reflection characteristics (1) to (3).

With respect to the requirement (1), if A/A0 is smaller than 1, the image has a concave surface curved undesirably. If A/A0 is larger than 2, the image has an image surface lacking smoothness sense undesirably.

In addition, with respect to the requirement (2), if $\Delta X_G WS/\Delta X_G WS0$ is larger than 10, waviness of the image is readily detected visually.

Further, with respect to the requirement (3), if B is smaller than 3×A0, flaws and dust in or on the image surface and curvature and creases of the image are apt to be visible undesirably. If B is larger than 6×A0, the image surface looks hazy undesirably.

If an electrophotographic image (or an electrostatic recording image) is taken as an example, a typical embodiment of the target image may be a digital photographic printing image G which is formed in such a manner that color toner layers 2 and a transparent toner layer 3 as the uppermost layer are laminated on a medium 1 having a diffuse reflection layer at least containing a white pigment and a thermoplastic resin.

In this embodiment, preferably, the combination of the medium 1 and the transparent toner layer 3 is formed so that the medium 1 at least has a raw paper sheet made of a pulp material, and a diffuse reflection layer laminated on the raw paper sheet, the diffuse reflection layer containing a polyethylene resin as a thermoplastic resin and titanium oxide particles dispersed as a white pigment in the polyethylene resin, and so that a resin for forming the transparent toner layer 3 is polyester; or the combination of the medium 1 and the transparent toner layer 3 is formed so that the medium 1 has a diffuse reflection layer containing a polyethylene terephthalate (PET) resin and a white pigment dispersed into the PET resin, and so that a resin for forming the transparent toner layer 3 is polyester.

A subject of the invention maybe an image-forming system for forming an image structure as well as the image structure itself.

In this case, as shown in FIG. 1B, the invention provides an image-forming system for forming an image G on a medium 1 by an image-creating unit 5, wherein at least a surface of the medium 1 is controlled so as to give an image structure having the predetermined optical reflection characteristics (1) to (3) to the image G on the medium 1.

The concept "target image" described in this embodiment includes an electrostatic recording image, an ink jet image and a silver halide photographic image as well as the electrophotographic image. Accordingly, the concept "image-creating unit" widely includes various types of image-creating units adapted to the respective kinds of images.

FIG. 1C is a typical embodiment of a system for forming an image structure (a digital photographic printing image G which is formed in such a manner that color toner layers 2 and a transparent toner layer 3 as the uppermost layer are laminated on a medium 1 having a diffuse reflection layer at least containing a white pigment and a thermoplastic resin) mainly for an electrophotographic image or an electrostatic recording image according to the invention. That is, as shown in FIG. 1C, the invention provides an image-forming system having an image-creating unit 5 for forming an image G on a medium 1, and a fixing unit 6 for fixing the image G formed by the image-creating unit 5 on the medium 1, wherein: the fixing unit 6 has a fixing member 6*a* brought into close contact with the image G on the medium 1 so that the image G is sandwiched between the fixing medium 6*a* and the medium 1; and surfaces of the fixing member 6*a* and the medium 1 are controlled in order to give an image structure having the predetermined optical reflection characteristics (1) to (3) to the image G on the medium 1.

In this embodiment, the image-creating unit 5 is an image-creating unit requiring the fixing unit 6. Typically, an image-creating unit adopting an electrophotographic method or an electrostatic recording method (latent image-forming process without any exposure process) may be used.

The fixing member 6*a* of the fixing unit 6 is not particularly limited. For example, a belt material or a roll material may be selected suitably for the fixing member 6*a*.

In this embodiment, it is further necessary to consider the surface characteristic of the fixing member 6*a* as well as the surface characteristic of the medium 1.

As a preferred example of the fixing unit 6 used in this embodiment, the fixing unit 6 further has a heating and pressurizing unit 7 for fixing color toner layers 2 and a transparent toner layer 3 onto the medium 1, and a cooling and releasing unit 8 for cooling the heated toner layers 2 and 3 on the medium 1 and releasing the toner layers 2 and 3 fixed onto the medium 1 from the fixing member 6*a*.

In this case, because the heating and pressurizing step and the cooling and releasing step (which may be performed separately or simultaneously) are required to be performed with a time difference, a belt material may be preferably used as the fixing member 6*a* so that the heating and pressurizing step and the cooling and releasing step can be arranged to be estranged from each other.

According to this configuration, when the cooling and releasing step is performed after the heating and pressurizing step, the surface characteristic of the fixing member 6*a* can be directly transferred onto the surface of the image G on the medium 1. Accordingly, a preferable image structure can be obtained if the surface characteristic of the fixing member 6*a* is good.

As a typical embodiment of this type image-forming system, the image-creating unit 5 has an electrostatic transfer unit for electrostatically transferring color toner layers 2 and a transparent toner layer 3 onto the medium 1 having a diffuse reflection layer at least containing a white pigment and a thermoplastic resin.

As another typical embodiment of this type image-forming system, the image-creating unit 5 has an electrostatic transfer unit for electrostatically transferring a layer of color toners 2 onto the medium 1 having a diffuse reflection layer at least containing a white pigment and a thermoplastic resin, and a transparent toner layer-forming unit for forming a transparent toner layer 3 on the fixing member 6*a* of the fixing unit 6, wherein the transparent toner layer 3 is laminated on the color toner layers 2 on the medium 1 by a nip portion between the fixing member 6*a* of the fixing unit 6 and the medium 1.

The optical reflection characteristics (1) and (3) are characteristics in a high-frequency region and mainly based on the melting characteristic of the transparent toner for forming the surface of the image structure and the surface structure of the fixing member 6*a* brought into contact with the transparent toner layer 3.

In this type image-forming system, as a preferred embodiment of the melting characteristic of the transparent toner for forming the surface of the image, the viscosity of the transparent toner is in a range of from $10^2$ Pa·s to $5\times10^3$ Pa·s at the toner layer temperature in the fixing process.

The selection of the viscosity condition is based on the following facts. If the viscosity is lower than $10^2$ Pa·s, the image is undesirable from the viewpoint of preventing the offset of the transparent toner. If the viscosity is higher than $5\times10^3$ Pa·s, the particle shape of the transparent toner remains (so that the optical reflection characteristic (1) cannot be satisfied).

With respect to preferred surface characteristic of the fixing member 6*a*, the angular distribution of surface reflection light beams under the condition that a surface of the fixing member 6*a* of the fixing unit 6 is irradiated with slit-transmitted light beams satisfies the characteristics (1) and (3).

On the other hand, the optical reflection characteristic (2) is a characteristic in a low-frequency region and mainly influenced by elastic strain of the fixing member 6*a* and/or the medium 1.

For example, as a preferred hardness characteristic of the fixing member 6*a*, the fixing member 6*a* has an elastic layer having a hardness of 30 degrees to 60 degrees (Asker C) and a thickness of 20 μm to 50 μm.

The preferred hardness characteristic is based on the following facts. If the elastic layer is too soft or too thick, the optical reflection characteristic (2) cannot be satisfied depending on the kind of each toner or the medium 1. If the elastic layer is too hard or too thin, a boundary between a high density area and a low density area can be hardly brought into close contact with the fixing member 6*a* so that a uniform surface cannot be formed.

As a preferred elastic characteristic of the medium 1, the fraction of voids in a portion of the medium 1 except the surface layer is not lower than 50%.

BRIEF DESCRIPTION OF THE DRAWINGS

The present invention may be more readily described with reference to the accompanying drawings:

FIG. 11 is an explanatory view showing respective characteristic values and results of subjective evaluation in Examples 1 to 3 and Comparative Examples 1 to 7.

DETAILED DESCRIPTION OF THE PREFERRED EMBODIMENTS

The invention will be described below in detail on the basis of embodiments shown in the accompanying drawings.

Embodiment 1

Figure 1A:
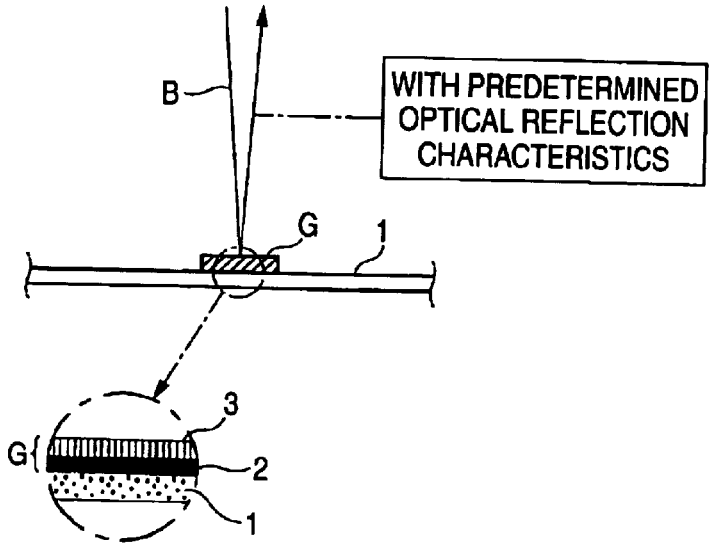
FIG. 1A is an explanatory view showing an image structure according to the invention.
Figure 1B:
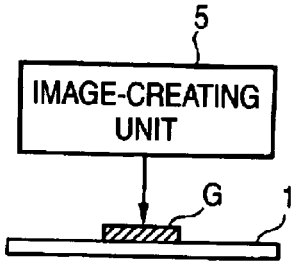
FIG. 1B is an explanatory view showing a basic configuration of an image-forming system for forming the image structure according to the invention.
Figure 1C:
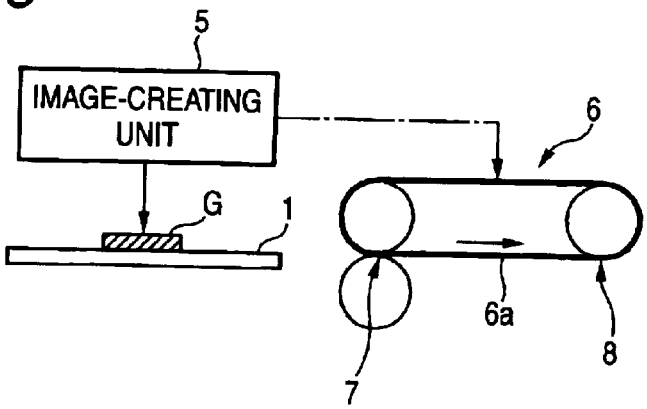
FIG. 1C is an explanatory view showing a typical example of the image-forming system for forming the image structure according to the invention.
Figure 2A:
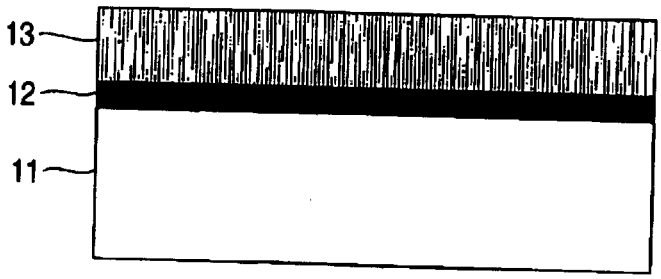
FIG. 2A is an explanatory view showing an image structure according to Embodiment 1 of the invention.

FIG. 2A is a cross-sectional view of a digital photographic print preferable in surface appearance, showing Embodiment 1 of an image structure according to the invention.

In FIG. 2A, the image structure is formed in such a manner that a layer of color toners 12 and a transparent toner layer 13 as the uppermost layer are superimposed on a medium 11 having a diffuse reflection layer at least containing a white pigment and a thermoplastic resin.

A known white pigment such as titanium oxide, silica, alumina, calcium carbonate or kaoline can be used as the white pigment in the diffuse reflection layer of the medium 11. A plurality of white pigments may be used in combination. It is preferable from the point of view of whiteness that titanium oxide is used as the white pigment.

On the other hand, a known resin such as polyethylene, polypropylene or polyester can be used as the thermoplastic resin.

The thickness of the medium 11 is preferably selected to be in a range of from 100 μm to 250 μm, both inclusively.

For example, the color toner layer 12 is formed in such a manner that known electrophotographic color toner particles having color pigments dispersed into a thermoplastic resin are melted and fixed.

The composition, mean particle size, etc. of each color toner can be selected suitably if the object of the invention is not impeded.

It is preferable from the point of view of adhesion to the medium 11 and low-temperature fixation that the thermoplastic resin is polyester. It is preferable from the point of view of charging characteristic and fluidity that inorganic fine particles such as silica particles or titanium oxide particles are deposited onto the toner particle surface. The particle size of each color toner is not particularly limited but it is preferable from the point of view of reproduction of a soft tone, resolution and granularity that the volume-average particle size is selected to be in a range of from 3 μm to 10 μm. It is more preferable that the toner particle size is selected to be in a range of from 4 μm to 8 μm, both inclusively, in consideration of a function of faithfully reproducing an electrostatic latent image by an exposure unit which will be described later.

Electrically insulating particles at least containing a binder resin and a colorant can be selected suitably as each color toner. Preferably, three kinds of color toners, that is, cyan, magenta and yellow toners may be used as the color toners. A black toner may be used in addition to the color toners.

The thickness of the color toner layer 12 varies in accordance with the color and density of the image. A white paper portion has no color toner layer 12, that is, the thickness of the color toner layer 12 varies in accordance with the density of the image. It is preferable from the point of view of obtaining preferable surface quality that the maximum thickness of the color toner layer 12 is not larger than 15 μm. The preferable surface quality will be described later.

Examples which will be listed as examples of a binder resin used in a transparent toner can be also used as examples of the binder resin used in each color toner. Preferably, the binder resin is polyester having a weight-average molecular weight of from 5,000 to 30,000.

Each colorant is not particularly limited if the colorant is a colorant generally used for a toner. Each colorant can be selected from a cyan pigment or dye, a magenta pigment or dye, a yellow pigment or dye and a black pigment or dye which are known in themselves. Preferably, it is important to suppress irregular reflection in the interface between the pigment of the colorant and the binder in order to enhance the effect of obtaining high gloss. For example, a combination of the binder resin and a colorant having a small particle size pigment dispersed into the binder resin is effective in suppressing the irregular reflection, as disclosed in Japanese Patent Laid-Open No. 242752/1992.

In this embodiment, the color toners may be produced suitably or may be goods available on the market.

Incidentally, each of the color toners is used after it is mixed with a carrier known in itself and selected suitably to form a developer. When each color toner is used in the form of a one-component developer, there may be also used means for frictionally charging the toner by a developing sleeve or a charging member to form a charged toner and developing the charged toner in accordance with an electrostatic latent image.

The transparent toner layer 13 is a layer of transparent toner particles melted and fixed.

From the point of view of obtaining surface quality which will be described later, the thickness of the transparent toner layer 13 is preferably selected to be not smaller than 10 $\mu$m. The thickness of the transparent toner layer 13 is however preferably selected to be not larger than 30 $\mu$m because the image is apt to curl or crack if the thickness is larger than 30 $\mu$m.

The transparent toner at least contains a thermoplastic binder resin.

The concept "transparent toner" used in this embodiment means toner particles containing no coloring material (color pigment, color dye, black carbon particles, black magnetic powder, etc.) used for coloring due to light absorption or light scattering.

In this embodiment, the transparent toner is generally colorless and transparent. Although the transparency of the transparent toner may be slightly lowered in accordance with the kind or amount of a fluidizing agent or a releasant contained in the transparent toner, any toner material-can be used as the transparent toner if the toner material is substantially colorless and transparent.

Any resin material can be selected suitably as the binder resin according to the purpose if the resin material is substantially transparent. Examples of the binder resin include: known resins such as a polyester resin, a polystyrene resin, a polyacrylic resin, any other vinyl resin, a polycarbonate resin, a polyamide resin, a polyimide resin, an epoxy resin or a polyurea resin generally used for a toner; and copolymers of the known resins. Particularly, a polyester resin is preferred because toner characteristics such as adhesion to the medium 11, low-temperature fixation, fixing strength and permanence can be satisfied simultaneously. The binder resin is preferably selected to have a weight-average molecular weight of 5,000 to 40,000, both inclusively, and a glass transition point from 55° C., inclusively, to 75° C., not inclusively.

In the transparent toner, it is necessary to control the fluidity and charging characteristic of the toner in order to obtain uniform high gloss. From the point of view of controlling the fluidity and charging characteristic of the transparent toner, it is preferable that inorganic fine particles and/or resin fine particles (organic fine particles) are externally added to or deposited on toner surfaces of the transparent toner.

The inorganic fine particles are not particularly limited if they do not impede the effect of the invention. The inorganic fine particles cane selected suitably from known fine particles used as external additives in accordance with the purpose. Examples of the material of the inorganic fine particles include silica, titanium dioxide, tin oxide, and molybdenum oxide. In consideration of stability of charging characteristic or the like, these inorganic fine particles may be treated with a silane coupling agent, a titanium coupling agent or the like to be made hydrophobic before they are used.

The organic fine particles are not particularly limited if they do not impede the effect of the invention. The organic fine particles can be selected suitably in accordance with the purpose from known fine particles used as external additives. Examples of the material of the organic fine particles include a polyester resin, a polystyrene resin, a polyacrylic resin, a vinyl resin, a polycarbonate resin, a polyamide resin, a polyimide resin, an epoxy resin, a polyurea resin, and a fluororesin.

Particularly preferably, the mean particle size of the inorganic and organic fine particles is selected to be in a range of from 0.005 $\mu$m to 1 $\mu$m. If the mean particle size is smaller than 0.005 $\mu$m, it maybe impossible to obtain a required effect because cohesive failure occurs when the inorganic fine particles and/or the resin fine particles are deposited on surfaces of the transparent toner. On the other hand, if the mean particle size is larger than 1 $\mu$m, it is difficult to obtain a higher gloss image.

Preferably, wax is added to the transparent toner.

The composition of the wax is not particularly limited if it does not disturb the effect of the invention. The wax can be selected suitably from known materials used as wax, in accordance with the purpose. Examples of the material of the wax include a polyethylene resin and carnauba natural wax. In this embodiment, 2% by weight, inclusively, to 8% by weight, not inclusively, of wax having a melting point of 80° C. to 110° C., both inclusively, is preferably added to the transparent toner.

The particle size of the transparent toner need not be particularly limited.

From the viewpoint of forming a thick toner layer without background, it is however preferable that the volume-average particle size of the transparent toner is in a range of from 10 $\mu$m to 25 $\mu$m.

Incidentally, the transparent toner is used after it is mixed with a carrier selected suitably and known in itself to form a developer. When the transparent toner is used in the form of a one-component developer, there maybe also used means for frictionally charging the toner by a developing sleeve or a charging member to form a charged toner and developing the charged toner in accordance with an electrostatic latent image.

Modification 1

Figure 2B:
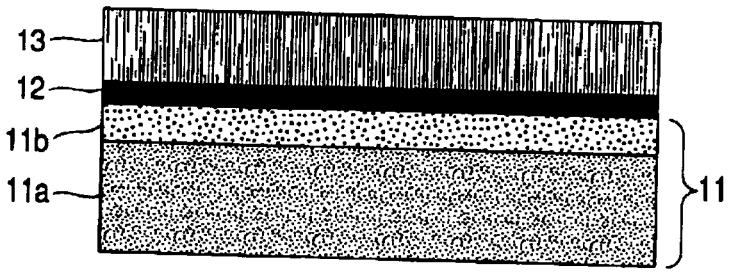
FIG. 2B is an explanatory view showing an image structure according to a modified example of Embodiment 1.

FIG. 2B is a cross-sectional view showing a modified embodiment of the digital photographic printing image which provides preferable surface appearance.

In FIG. 2B, the color toner layer 12 and the transparent toner layer 13 are the same as those in FIG. 2A. The modified embodiment shown in FIG. 2B is different from the embodiment shown in FIG. 2A in that a medium constituted by a raw paper sheet 11*a* made of a pulp material, and a diffuse reflection layer 11*b* formed in the same manner on the raw paper sheet 11a is provided as the medium 11.

Preferably, the thickness of the raw paper sheet 11*a* is selected to be in a range of from 100 $\mu$m to 250 $\mu$m. Preferably, the thickness of the diffuse reflection layer 11*b* is selected to be in a range of from 10 $\mu$m to 40 $\mu$m.

A gelatin layer or an antistatic layer of colloidal silica, colloidal alumina or the like may be preferably formed on the diffuse reflection layer 11*b*.

A gelatin layer or an antistatic layer of colloidal silica, colloidal alumina or the like may be also preferably formed on the rear surface of the raw paper sheet 11*a*.

Modification 2

Figure 2C:
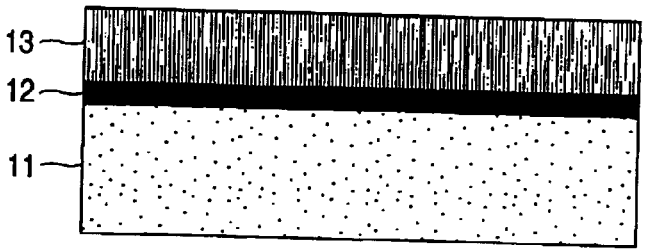
FIG. 2C is an explanatory view showing an image structure according to another modified example of Embodiment 1.

FIG. 2C is a cross-sectional view showing another modified embodiment of the digital photographic printing image which provides apparently preferable surface quality.

In FIG. 2C, the color toner layer 12 and the transparent toner layer 13 are the same as those in FIG. 2A. The modified embodiment shown in FIG. 2C is different from the embodiment shown in FIG. 2A in that a PET resin containing white pigment particles dispersed therein is used as the medium 11.

Figure 3A:
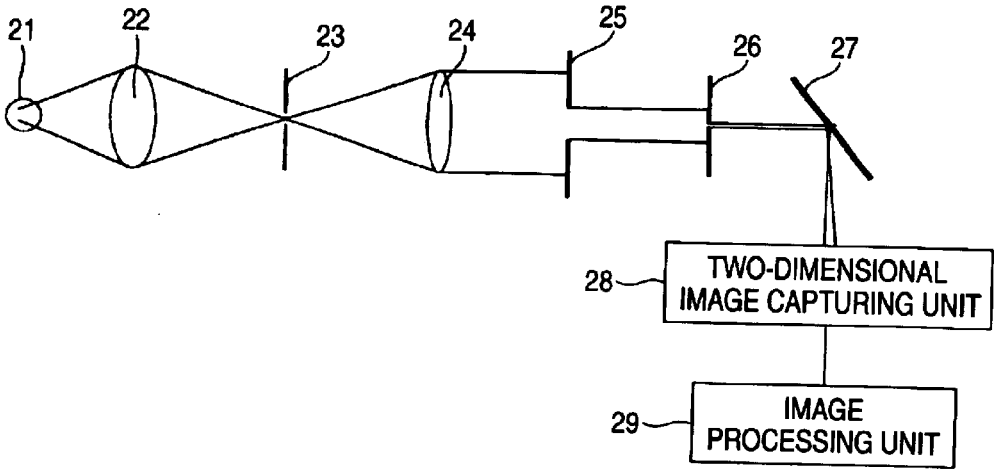
FIG. 3A is an explanatory view showing an example of an evaluation system for obtaining optical reflection characteristics for the image structure formed in each of Embodiment 1 and modified examples of Embodiment 1.

Preferably, the thickness of the medium 11 is selected to be in a range of from 80 $\mu$m to 200 $\mu$m Characteristic Evaluation System FIG. 3A shows an example of a characteristic evaluation system for evaluating optical reflection characteristics of the image structure according to Embodiment 1 (or Modification 1 or 2).

In the characteristic evaluation system shown in FIG. 3A, light emitted from a light source 21 is converged by a lens 22. The size of the light is narrowed by a pinhole 23. The light is collimated to a collimated light flux by a collimator lens 24. The collimated light flux is narrowed by a luminous flux stop 25 to form a parallel collimated light flux having a required size. The collimated light flux is applied onto an image 27 according to Embodiment 1 (or Modification 1 or 2) at an incident angle of 45 degrees through an aperture unit 26. The specular reflected light at the image 27 of the collimated light flux is applied onto a two-dimensional image capturing unit 28 located in a direction of surface reflection with respect to the incident light flux, so that an intensity distribution of the surface reflected light is measured.

The intensity distribution is analyzed by an image processing unit 29 as to a distribution in an X direction corresponding to that perpendicular to the direction of the slit length in the aperture unit 26 and a distribution in a Y direction corresponding to that parallel to the direction of the slit length.

A 50 W halogen lamp is used as the light source 21.

The lens 22 is provided for condensed light from the light source 21 into the position of the pinhole 23 to thereby increase the intensity of light in the pinhole 23. In this characteristic evaluation system, for example, a lens having a focal length of 15 mm and an aperture of 20 mmΦ is used as the lens 22.

The pinhole 23 has a function of enhancing the degree of collimation of the collimated light flux transmitted through the collimator lens 24. The degree of collimation becomes higher as the size of the pinhole 23 becomes smaller. The intensity of the collimated light flux is however reduced in proportional to the area of the pinhole 23. Accordingly, a preferred size of the pin hole 23 may be selected in consideration of brightness of illumination, sensitivity of a sensor, and so on. In this characteristic evaluation system, a light blocking metal film and provided with a 0.2 mmΦ small hole is used as the pinhole 23.

The collimator lens 24 is provided for collimating light passed through the pinhole 23. As the focal length f of the collimator lens 24 becomes larger, the obtained degree of collimation becomes higher. A lens having a focal length of 200 mm and an aperture of 40 mmΦ is used as the collimator lens 24 in consideration of the size of the system, and so on.

Figure 3B:
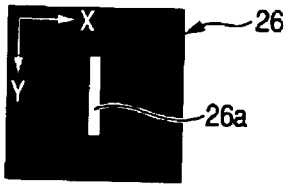
FIG. 3B is an explanatory view showing the shape of an aperture in the evaluation system.

As shown in FIG. 3B, the aperture unit 26 has a narrow slit 26*a* for forming a transmitted light flux of bar shape. In this characteristic evaluation system, a rectangular slit 0.4 mm wide and 10 mm long is used as the slit 26*a*.

The reason why such a slit 26*a* is selected is as follows: the resolution of evaluation becomes higher as the line width for illuminating the image becomes smaller. If the width of the slit 26*a* is large, surface quality information in the direction of the line width is averaged so that required resolution cannot be obtained. On the other hand, if the line width is too small, the intensity of the transmitted light incident onto the sensor is reduced and the bar-shaped image is spread by diffraction. Accordingly, the 0.4 mm-wide slit 26*a* is used in consideration of balance between these facts.

On the other hand, the volume of information increases as the length of the slit 26*a* increases. The length of the slit 26*a* is selected in consideration of the diameter of the collimated light flux and the size of the sensor.

As the distance between the aperture unit 26 and the image 27 decreases, the influence of diffraction decreases so that the width for illuminating the image is narrowed. Therefore, the distance between the aperture unit 26 and the image 27 is selected to be 15 mm which is the minimum distance free from interference between the slit 26*a* and the image 27.

On the other hand, an image holder or the like is used for fixing the image 27 so that the smooth surface of the image 27 can be retained. The angle between the collimated light flux and a line normal to the image 27 is 45 degrees.

Then, the intensity distribution of light reflected by the surface of the image 27 is measured by the two-dimensional image capturing unit 28. A two-dimensional CCD camera ("Mega-Plus 4.2" made by EASTMAN KODAK COMPANY) having 2048×2048 pixels with a pixel size of 9 $\mu$m and provided with an infrared cut filter is used as the two-dimensional image capturing unit 28.

In order to reduce noise, image pick-up is performed under the condition of a shutter speed of 500 ms and a gain of −6 dB. An ND filter is inserted in front of the slit to keep the maximum amount of reflected light in an 8 bit range to thereby adjust the amount of exposure. The distance between the image surface and the image capturing surface is selected to be 165 mm.

As a result, the angle of light from the reflection surface is equivalent to $5.45\times10^{-5}$ rad (0.00313 degrees) per pixel.

Because the evaluation values (1) to (3) which will be described later are compared with values obtained in a standard gloss plate (gloss measuring standard plate), the coordinate value of each pixel which is almost proportional to the angular value can be directly used in place of the angular value for calculating the evaluation values.

Figure 4A:
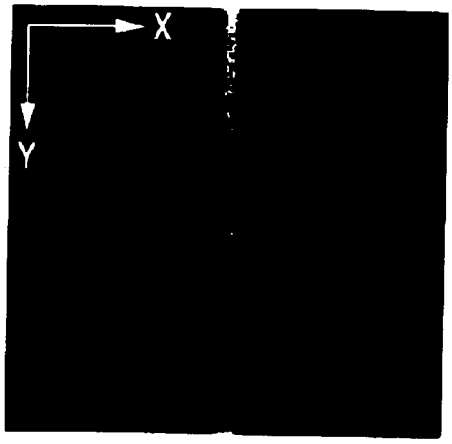
FIGS. 4A and 4B are explanatory views showing examples of an image captured by the two-dimensional image capturing unit.
Figure 4B:
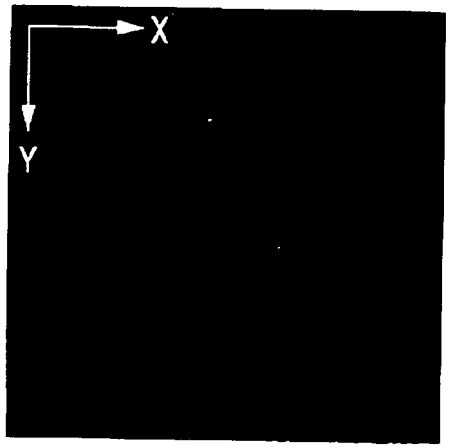

FIGS. 4A and 4B show examples of the captured image.

FIG. 4A shows an image obtained with a standard gloss plate. FIG. 4B shows an image obtained with a photo-quality paper sheet. Incidentally, the latter shows the case where an image structure is out of the preferred range of this embodiment.

In the image processing unit 29, the intensity distribution obtained by the two-dimensional image capturing unit 28 is stored as an image having a distribution in the X direction corresponding to that perpendicular to the direction of the length of the bar-shaped image and a distribution in the Y direction parallel to the direction of the length of the bar-shaped image. After the dark current of the CCD, reset noise and inclination of the X and Y axes are corrected, the evaluation values (characteristic values) (1) to (3) are calculated as follows.

(1) Calculation of Half-Value Width

The maximum value Rmax of reflectance is obtained on the basis of an X-direction reflection distribution in each Y position. When A(Y) is the absolute value of a difference between two X values of reflectance equal to a half of the maximum value, A is calculated by the following equation.

$$\text{Average Half-Value Width: } A=\Sigma A(i)/n$$

On the other hand, in the condition that a gloss measuring standard plate (black, Gloss 96.8) made by MURAKAMI COLOR RESEARCH LABORATORY in place of the evaluation image is put on the image fixing table, A0 is obtained in the same measurement/calculation manner as described above (see FIG. 4A).

If A/A0 is smaller than 1, good surface quality cannot be obtained because the image is curved so that the front surface becomes a concave surface. If A/A0 is larger than 2, a good impression of the surface of the image is not given because the surface is spoiled in terms of smoothness. (2) Calculation of Appearance of Center-of-gravity Fluctuation $\Delta X_G$WS The characteristic value (2) is an index corresponding to appearance of waviness of the reflected image and calculated as follows.

First, the X coordinate XG(y) of the center of gravity in each Y position is calculated by the following equation:

$$X_G(y)=\Sigma\{j\cdot R(j,y))/\Sigma R(j,y)$$

in which R(j,y) is the value of reflectance in the case of X=j and Y=y.

Appearance of center-of-gravity fluctuation $\Delta X_G$WS is calculated by the following equations:

$$\Delta X_G(u)=\int \Delta X_G(y)\cdot e^{-2}\Pi^{iuy}\, dy$$

$$\Delta X_G WS=\int \Delta X_G(u)\cdot VTF(u)du$$

in which VTF(u) is calculated by the following equations:

$$VTF(u)=5.05\cdot e^{-0.843u}\cdot(1-e^{-0.611u}) \text{ in the case of } u\geqq 0.78,$$

and $$VTF(u)=1.00 \text{ in the case of } u<0.78.$$

On the other hand, in the condition that a gloss measuring standard plate (black, Gloss 96.8) made by MURAKAMI COLOR RESEARCH LABORATORY in place of the evaluation image is put on the image fixing table, appearance of center-of-gravity fluctuation $\Delta X_G$WS0 is obtained in the same measurement/calculation manner as described above.

If $\Delta X_G$WS/$\Delta X_G$WS0 is larger than 10, an image having good surface appearance cannot be obtained because waviness of the image is conspicuous.

(3) Calculation of One-Tenth Value Width

The maximum value Rmax of reflectance is obtained on the basis of an X-direction reflection distribution in each Y position. When B(Y) is the absolute value of a difference between two X values of reflectance equal to one tenth of the maximum value Rmax, B is calculated by the following equation.

$$\text{Average One-Tenth Value Width: } B=\Sigma B(i)/n$$

If B is smaller than 3×A0, the image presents an undesirable appearance because the curve or crease of the image is apt to be conspicuous as well as a defect or dirt on the surface of the image is apt to be conspicuous. If B is larger than 6×A0, a good impression of the image is not given and the image is inferior in color reproducibility and high-density reproducibility because the surface of the image is not smooth and looks hazy.

Embodiment 2

An example (Embodiment 2) of a color image-forming system for forming an image structure according to Embodiment 1 (or Modification 1 or 2) will be described below.

Figure 5:
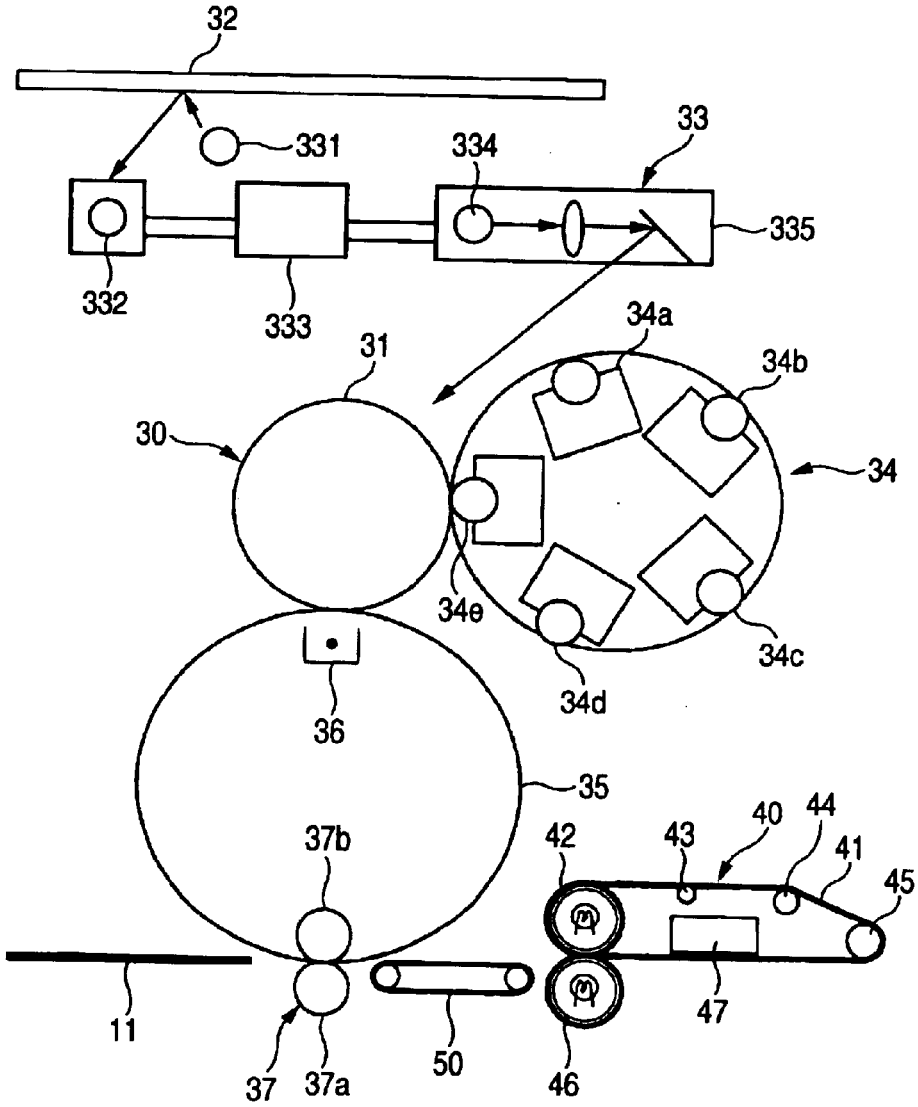
FIG. 5 is an explanatory view showing Embodiment 2 of the image-forming system according to the invention.

For example, as shown in FIG. 5, the color image-forming system according to this embodiment has an image-creating unit 30, a fixing unit 40, and a conveyer unit 50. The image-creating unit 30 forms a photographic image (see FIGS. 2A to 2C) so that color toner layers 12 and a transparent toner layer 13 as the uppermost layer are laminated on a medium 11 at least having a diffuse reflection layer at least containing a white pigment and a thermoplastic resin. The fixing unit 40 fixes the respective toner layers formed by the image-creating unit 30 on the medium 11. The conveyer unit 50 conveys the medium 11 having the image formed thereon, to the fixing unit 40.

In this embodiment, a known electrophotographic type toner image-forming unit is used as the image-creating unit 30.

Any unit can be selected suitably as the fixing unit 40. Preferably, the fixing unit 40 has a belt-like fixing member (fixing belt 41), a heating and pressurizing unit for heating and pressurizing the image on the medium 11 through the belt-like fixing member, and a cooling and releasing unit for cooling and releasing the heated and pressurized medium.

In this embodiment, a film of a polymer such as polyimide can be used as the belt-like fixing member. Preferably, electrically conductive additives such as electrically conductive carbon particles or an electrically conductive polymer may be dispersed into the belt-like fixing member so that the resistance value of the belt-like fixing member can be adjusted. The belt-like fixing member may be shaped like a sheet or may be preferably shaped like an endless belt. It is preferable from the point of view of releasability and surface quality that the belt surface is coated with a silicone resin and/or a fluororesin.

A known unit can be used as the heating and pressurizing unit.

For example, there can be used a unit in which the belt-like fixing member and the medium 11 having the image formed thereon are driven while sandwiched between a pair of rolls driven at a constant velocity.

For example, in the unit, one or each of the rolls has a heat source in its inside so that the surface of the roll is heated to a temperature at which the transparent toner can be melted. The two rolls are brought into pressure contact with each other. Preferably, the surface of one or each of the two rolls is coated with silicone rubber or fluoro rubber and the length of a heated and pressurized region of the roll is in a range of from about 1 mm to about 8 mm.

For example, a unit in which the medium 11 heated and pressurized through the belt-like fixing member is cooled and then released through a releasing member can be used as the cooling and releasing unit.

In this case, though natural cooling may be used as cooling means, it is preferable from the viewpoint of the dimension of the system that a cooling member such as a heat sink or a heat pipe is used for making the cooling speed high. Preferably, as the releasing member, a striping finger may be inserted in between the belt-like fixing member and the medium 11 or a small-curvature roll (release roll) may be provided in the release position for releasing the medium 11.

A conveyer unit which is known in itself can be used as the conveyer unit 50 for conveying the medium 11 having the color image formed thereon to the fixing unit 40. It is preferable that the speed of conveyance is constant. Therefore, for example, there can be used a unit in which the medium 11 is driven while sandwiched between a pair of rubber rolls rotating at a constant rotational speed or a unit in which the medium 11 is driven at a constant velocity in the condition that the medium 11 is placed on a belt of rubber or the like bridged between a pair of rolls one of which is driven at a constant velocity by a motor or the like. When an unfixed toner image is formed, the latter unit is preferably used so that the toner image is not disturbed.

The image-forming system shown in FIG. 5 will be described below more specifically.

In FIG. 5, the image-creating unit 30 has a charger not shown, an exposure unit 33, a rotary development unit 34, an intermediate transfer belt 35, a cleaning unit not shown, a primary transfer unit (e.g., transfer corotron) 36, and a secondary transfer unit 37. The charger, the exposure unit 33, the rotary development unit 34, the intermediate transfer belt 35 and the cleaning unit are arranged around a photoconductor drum 31. The exposure unit 33 forms an electrostatic latent image on the photoconductor drum 31 by exposing with scanning data of an original 32. The rotary development unit 34 has development units 34*a* to 34*e* in which respective color toners of yellow, magenta, cyan and black and a transparent toner are stored. The intermediate transfer belt 35 temporarily holds the image transferred from the photoconductor drum 31. The cleaning unit cleans the toners remaining on the photoconductor drum 31. The primary transfer unit 36 is arranged in a portion of the intermediate transfer belt 35 opposite to the photoconductor drum 31. The secondary transfer unit 37 is arranged in a portion of the intermediate transfer belt 35 through which the medium 11 passes. In this embodiment, the secondary transfer unit 37 has a transfer roll 37*a* and a backup roll 37*b* paired with the transfer roll 37*a* so that the intermediate transfer belt 35 and the medium 11 are sandwiched between the transfer roll 37*a* and the backup roll 37*b*.

In this embodiment, the exposure unit 33 has an illumination lamp 331, a color scanner 332, an image processing unit 333, a laser diode 334, and an optical system 335. The original 32 is illuminated with light from the illumination lamp 331. Light reflected from the original 32 is separated into colors by the color scanner 332. The color-separated light is image-processed by the image processing unit 333. Then, an exposure point of the photoconductor drum 31 is irradiated with a light beam for an electrostatic latent image-writing, for example, through the laser diode 334 and the optical system 335.

The fixing unit 40 has a fixing belt 41, a heat roll 42, a release roll 45, a pressure roll 46, and a heat sink 47. The fixing belt 41 is bridged over a suitable number of set rolls (in this embodiment, four set rolls 42 to 45). For example, a belt material having its surface coated with silicone rubber is used as the fixing belt 41. The heat roll 42 is the tension roll located in the feeding side of the fixing belt 41 and capable of being heated. The release roll 45 is the tension roll located in the exhaust side of the fixing belt 41 and capable of releasing the medium 11. The pressurizing roll 46 is arranged opposite to the heat roll 42 so that the fixing belt 41 is sandwiched between the heat roll 42 and the pressurizing roll 46 brought into pressure contact with each other. A heat source may be added to the pressurizing roll 46 as occasion demands. The heat sink 47 is provided in the inside enclosed by the fixing belt 41, and used as a cooling member for cooling the fixing belt 41 and the medium 11 in the middle between the heat roll 42 and the release roll 45.

The operation of the image-forming system according to this embodiment will be described below.

As shown in FIG. 5, a color copy is made by use of the image-forming system according to this embodiment is performed as follows. First, the original 32 to be copied is illuminated with light from the illumination lamp 331. Light reflected from the original 32 is separated into colors by the color scanner 332. The color-separated light is image-processed by the image processing unit 333 to perform color correction. Image data of color toners and image data of a transparent toner obtained by the color correction are modulated in accordance with the colors by the laser diode 334 to thereby generate modulated laser light beams.

The laser light beams are sequentially irradiated onto the photoconductor drum 31 color by color by a plurality of times to form a plurality of electrostatic latent images. The plurality of electrostatic latent images are developed successively by the transparent toner development unit 34*e*, the yellow development unit 34*a*, the magenta development unit 34*b*, the cyan development unit 34*c* and the black development unit 34*d* using a transparent toner and four-color toners of yellow, magenta, cyan and black respectively.

The developed color toner images and the developed transparent toner image are successively transferred from the photoconductor drum 31 onto the intermediate transfer belt 35 by the primary transfer unit 36 (transfer corotron). The transparent toner image and the four-color toner images transferred onto the intermediate transfer belt 35 are collectively transferred onto the medium 11 by the secondary transfer unit 37.

Figure 6:
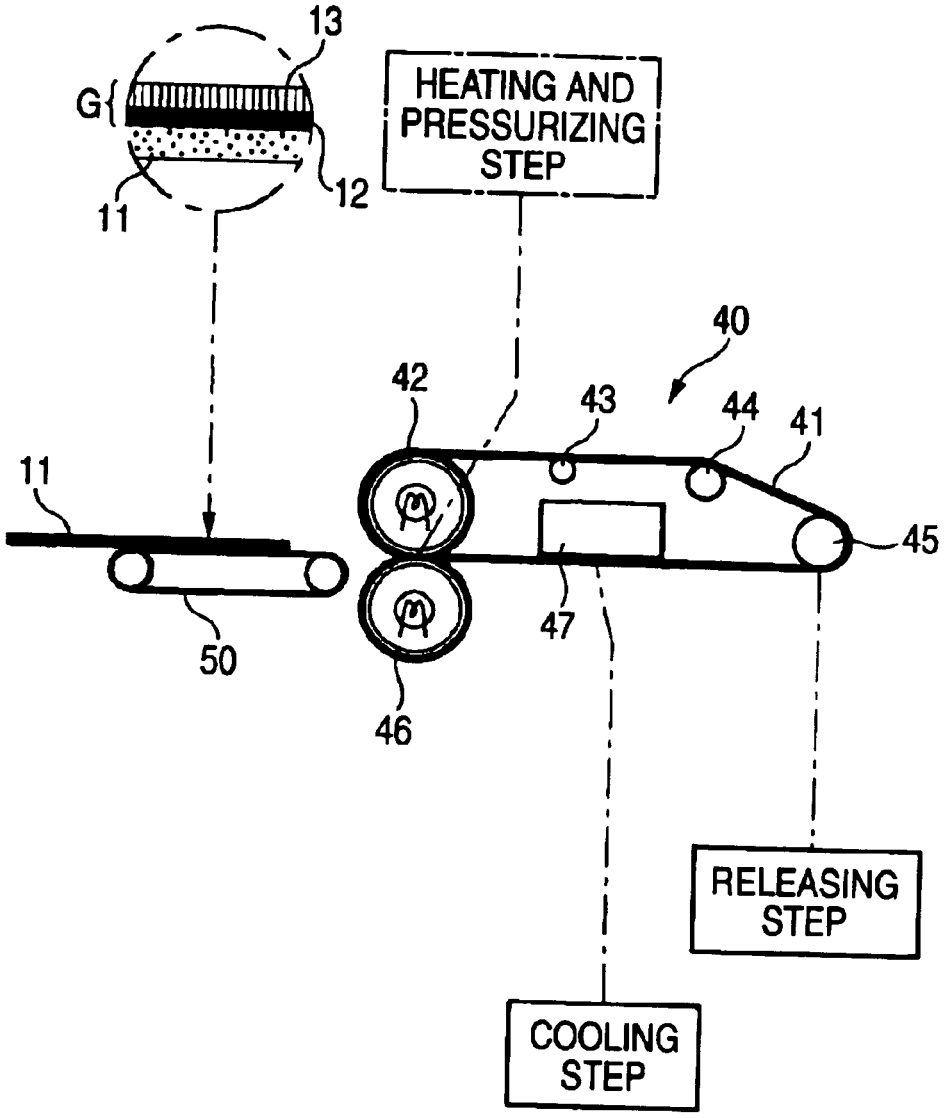
FIG. 6 is an explanatory view showing an image fixing step in Embodiment 2.

As shown in FIG. 6, the medium 11 having the color toner images and the transparent toner image formed in this manner is conveyed to the fixing unit 40 through the conveyer unit 50.

Next, the operation of the fixing unit 40 will be described. Both the heat roll 42 and the pressurizing roll 46 are heated to a toner melting temperature in advance. For example, a load of 100 kg weight is applied between the two rolls 42 and 46. The two rolls 42 and 46 are further driven to rotate, so that the fixing belt 41 is driven following the two rolls 42 and 46.

The fixing belt 41 is brought into contact with the surface of the medium 11, on which the color toner images and the transparent toner image are formed, in a nip portion between the heat roll 42 and the pressurizing roll 46. As a result, the color toner images and the transparent toner image are heated and melted (heating and pressurizing step).

Then, the medium 11 and the fixing belt 41 are carried to the release roll 45 while the medium 11 and the fixing belt 41 are unified through the melted toner layer. During the conveyance, the fixing belt 41, the transparent toner image, the color toner images and the medium 11 are cooled by the heat sink 47 (cooling step).

Accordingly, when the medium 11 reaches the release roll 45, the transparent toner image, the color toner images and the medium 11 are collectively released from the fixing belt 41 on the basis of the curvature of the release roll 45 (releasing step).

In this manner, a high glossy color image is formed on the medium 11.

In the image-forming process, the medium 11 and the fixing belt 41 need to be selected so that the evaluation values of the optical reflection characteristics (1) to (3) of the image structure are in required ranges respectively.

For example, as for the requirement (1), if A/A0 is larger than 2, it is preferable that the surface roughness of the fixing belt 41 is reduced.

On the other hand, if A/A0 is smaller than 1, it is preferable that the thickness of the medium 11 is increased or a thermoplastic resin layer is provided on the rear surface of the medium 11.

As for the requirement (2), if $\Delta X_G WS/\Delta X_G WS0$ is larger than 10, it is preferable that raw paper high in smoothness and even in formation is used or it is preferable that a rubber layer is made harder or thinner when the rubber layer is provided on the surface of the fixing belt 41.

Further, as for the requirement (3), if B/B0 is smaller than 3, it is preferable that a fixing belt 41 having a rubber layer containing inorganic or organic filler or fine particles as additives in its surface is used.

If B/B0 is larger than 6, it is preferable that a fixing belt 41 fine in surface smoothness is used or it is preferable that the size of filler or fine particles is reduced when a belt having a rubber layer containing inorganic or organic filler or fine particles as additives in its surface is used.

More specifically, with respect to the surface of the fixing belt 41, it is preferable that the fixing belt 41 is selected to satisfy the optical reflection characteristics (1) and (3).

In this case, when the melting characteristic of the transparent toner constituting the surface of the image G is selected to be in a preferable range, the surface shape of the fixing belt 41 is directly transferred onto the image G on the medium 11.

The preferable melting characteristic of the transparent toner can be obtained when the viscosity of the toner resin is in a range of from $10^2$ Pa·s to $5\times10^3$ Pa·s at the temperature of the toner layer in the fixing step.

If the viscosity is lower than $10^2$ Pa·s, there is problem in offset of the transparent toner image (the transparent toner having a tendency to remain on the fixing belt 41). If the viscosity is higher than $5\times10^3$ Pa·s, the particle shape of the transparent toner remains in the surface of the image to make it difficult to satisfy the requirement (3).

Incidentally, in this embodiment, the viscosity is measured, for example, with a rotary flat plate type rheometer (RDAII made by RHEOMETRIC SCIENTIFIC INC.) under the condition of a distortion rate of 20% and an angular velocity of 1 rad/sec.

Further, a factor contributing to the requirement (2) is the elasticity of the fixing belt 41 and the medium 11.

The preferable hardness characteristic of the fixing belt 41 can be obtained when the fixing belt 41 has an elastic layer having a hardness (Asker C) of 30 degrees to 60 degrees and a thickness of 20 $\mu$m to 50 $\mu$m.

If the hardness is too low or the elastic layer is too thick, the requirement (2) cannot be satisfied in accordance with the toners and the medium 11.

On the other hand, if the hardness is too high or the elastic layer is too thin, a uniform surface cannot be obtained because the boundary between a high density area and a low density area hardly adheres to the fixing belt 41.

The preferable elasticity characteristic of the medium 11 can be also obtained when the fraction of voids in a paper portion of the medium 11 except the surface layer is not lower than 50%.

Incidentally, in this embodiment, the fraction of voids is measured with a porosimeter (made by SHIMADZU CORPORATION) using mercury porosimetry.

Embodiment 3

An example (Embodiment 3) of the color image-forming system for forming an image structure according to Embodiment 1 (or Modification 1 or 2) will be described below.

Figure 7:
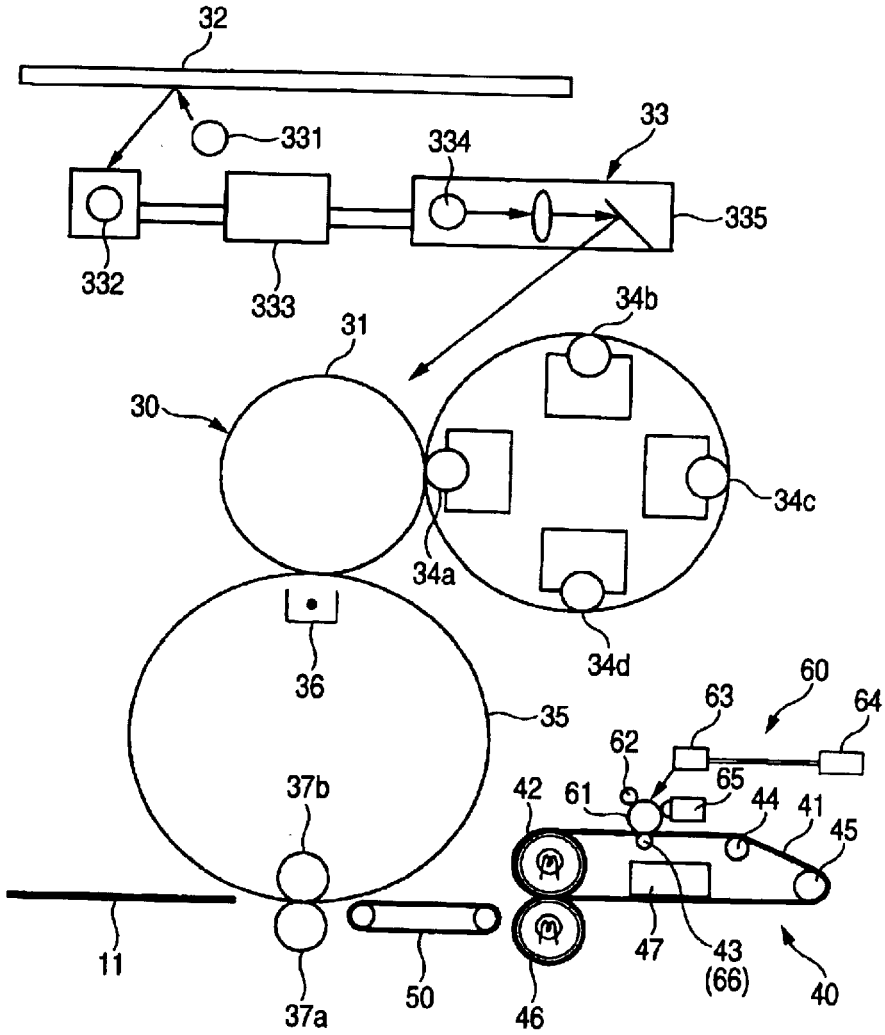
FIG. 7 is an explanatory view showing Embodiment 3 of the image-forming system according to the invention.

For example, as shown in FIG. 7, the color image-forming system according to this embodiment has: an image-creating unit 30 for forming a photographic image (see FIGS. 2A to 2C) constituted by a combination of color toner layers 12 and a transparent toner layer 13 on a medium 11 at least having a diffuse reflection layer at least containing a white pigment and a thermoplastic resin; a fixing unit 40 for fixing the respective toner layers formed by the image-creating unit 30 on the medium 11; and a conveyer unit 50 for conveying the medium 11 having the image formed thereon to the fixing unit 40. This embodiment is different from Embodiment 2 in that a transparent toner image-forming unit 60 for forming a transparent toner image on the belt-like fixing member (fixing belt 41) of the fixing unit 40 is provided in place of the transparent toner development unit 34*e* of the rotary development unit 34 in the image-creating unit 30.

The basic configurations of the image-creating unit 30, the fixing unit 40 and the conveyer unit 50 in this embodiment are substantially equivalent to those in Embodiment 2. In Embodiment 3, constituent parts the same as those in Embodiment 2 are referred to by the same numerals as those in Embodiment 2, so that detailed description thereof will be omitted.

Particularly in this embodiment, the transparent toner image-forming unit 60 has a transparent toner image carrier 61 (which may be shaped like a drum or a belt), and respective devices for forming a transparent toner image on the transparent toner image carrier 61.

In this embodiment, a polymer film such as a polyimide film can be used as the transparent toner image carrier 61. Preferably, electrically conductive additives such as electrically conductive carbon particles or an electrically conductive polymer may be dispersed into the polymer film to adjust the resistance value of the polymer film in order to stably form a transparent toner image constant in quantity.

The transparent toner image carrier 61 may be shaped like a sheet or may be preferably shaped like an endless belt. It is also preferable from the point of view of releasability that a surface of the belt is coated with a silicone resin and/or a fluororesin. It is further preferable from the point of view of smoothness that the surface gloss measured with a 75° gloss meter is not lower than 60.

The devices for forming the transparent toner image may be selected suitably. Development units known in themselves can be used as the devices.

For example, in a position where a roll grounded or supplied with a bias voltage comes into contact with the rear surface of the transparent toner image carrier 61, a transparent toner layer may be directly developed on the transparent toner image carrier 61 by a one-component development unit or a two-component development unit opposite to the transparent toner image carrier 61.

In this case, it is preferable that the temperature of the transparent toner image carrier 61 in the position of the transparent toner image development unit is not higher than 60° C.

When electrophotography is adopted in the transparent toner image-forming unit 60, it is preferable that, for example, a photoconductor drum is used as the transparent toner image carrier 61 and that the transparent toner image-forming unit 60 has a charger 62 arranged opposite to the photoconductor drum 61, an exposure unit 63 for exposing the photoconductor drum 61, a signal-generating unit 64 for controlling a transparent toner image-forming region on the color image, a transparent toner image development unit 65 arranged opposite to the photoconductor drum 61, and a transfer unit 66 for transferring the transparent toner image formed on the photoconductor drum 61 onto the belt-like fixing member (fixing belt) 41.

In this embodiment, the photoconductor drum 61 is not particularly limited and a known photoconductor drum may be used as the photoconductor drum 61. The photoconductor drum 61 may be of a monolayer structure or may be of a separated function type multilayer structure. The material of the photoconductor drum 61 may be an inorganic material such as selenium or amorphous silicon or may be an organic material.

Means known in itself, such as a contact charger using an electrically conductive or semiconductive roll, brush, film or rubber blade, or a corotron or scorotron charger using corona discharge, can be used as the charger 62.

A laser scanning system (ROS: Raster Output Scanner) having a semiconductor laser, a scanning unit and an optical system may be used as the exposure unit 63 or any other known light source for exposure such as an LED head or a halogen lamp may be used as the exposure unit 63.

In this embodiment, the exposure unit 63 is provided with the signal-generating unit 64. In consideration of preferred embodiment in which the region of an image to be exposed, that is, the position of the medium 11 to be covered with the transparent toner image is changed to a required range on the basis of the transparent region signal, a laser scanning system or an LED head may be preferably used as the exposure unit 63.

Any known development unit can be used as the transparent toner image development unit 65 regardless of whether the development unit is a one-component development unit or a two-component development unit so long as the development unit can achieve the purpose of forming a uniform transparent toner layer on the photoconductor drum 61. Although this embodiment has shown the case where the range of formation of the transparent toner layer is controlled on the basis of the signal issued from the signal-generating unit 64, the invention may be also applied to the case where the transparent toner layer is formed particularly on the whole surface of the medium 11.

A known method can be used in the, transfer unit 66. For example, there may be used a method in which an electrically conductive or semiconductive roll, brush, film or rubber blade supplied with a voltage is used for generating electric field between the photoconductor drum 61 and the fixing belt 41 to thereby transfer charged transparent toner particles, or a method in which a corotron or scorotron charger using corona discharge is used for corona-charging the rear surface of the fixing belt 41 to thereby transfer charged transparent toner particles. Incidentally, FIG. 7 shows the case where the set roll 43 is used as a functional member of the transfer unit 66.

Next, the operation of the image-forming system according to this embodiment will be described.

As shown in FIG. 7, when the image-forming system according to this embodiment is to be used for making a color copy, the original 32 as a subject of copying is first irradiated with light emitted from the illumination lamp 331. The light reflected from the original 32 is separated into colors by the color scanner 332. The color-separated light is image-processed and corrected by the image processing unit 333 to thereby obtain image data of a plurality of color toners and image data of a transparent toner. The image data are modulated in accordance with the colors by the laser diode 334 to thereby generate modulated laser beams.

The photoconductor drum 31 is sequentially irradiated with the laser beams color by color by a plurality of times to thereby form a plurality of electrostatic latent images. The plurality of electrostatic latent images are sequentially developed by the yellow development unit 34*a*, the magenta development unit 34*b*, the cyan development unit 34*c* and the black development unit 34*d* using four color toners of yellow, magenta, cyan and black respectively.

The developed color toner images on the photoconductor drum 31 are sequentially transferred onto the intermediate transfer belt 35 by the primary transfer unit 36 (transfer corotron). The four-color toner images transferred onto the intermediate transfer belt 35 are collectively transferred onto the medium 11 by the secondary transfer unit 37.

Figure 8:
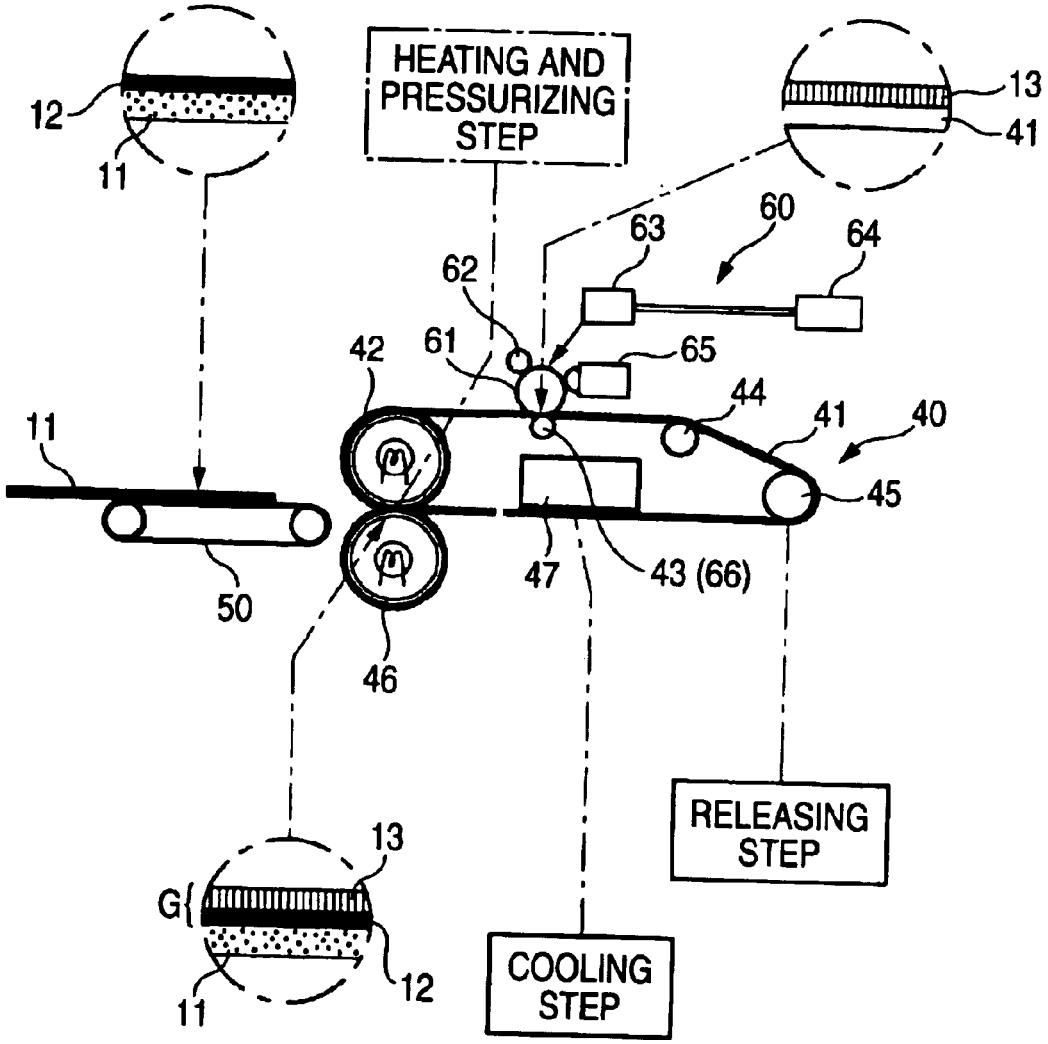
FIG. 8 is an explanatory view showing an image fixing step in Embodiment 3.

As shown in FIG. 8, the medium 11 having the color toner images formed thereon in this manner is conveyed into the fixing unit 40 through the conveyer unit 50.

Next, the operations of the fixing unit 40 and the transparent toner image-forming unit 60 will be described.

Both the heat roll 42 and the pressurizing roll 46 are heated to a toner melting temperature in advance. For example, a load of 100 kg weight is applied between the two rolls 42 and 46. The two rolls 42 and 46 are further driven to rotate, so that the fixing belt 41 is driven following the two rolls 42 and 46.

The photoconductor drum 61, which serves as the transparent toner image carrier of the transparent toner image-forming unit 60, rotates in synchronism with the conveyance of the medium 11. A bias voltage is applied to the charger (e.g., charge roll) 62, so that the photoconductor drum 61 is electrically charged evenly. The photoconductor drum 61 is exposed by the exposure unit 63 on the basis of the image signal issued from the signal-generating unit 64.

In this case, the potential of the exposed portion is lowered, so that this portion is developed by the transparent toner image development unit 65. Then, as shown in FIG. 8, the transparent toner image on the photoconductor drum 61 is transferred onto the fixing belt 41 by the transfer unit (transfer roll) 66 supplied with a bias voltage.

Then, the fixing belt 41 having the transparent toner image transferred thereonto and the surface of the medium 11 having the color toner images formed thereon come into contact with each other in a nip portion between the heat roll 42 and the pressurizing roll 46, so that the color toner images (color toner layer 12) and the transparent toner image (transparent toner layer 13) are heated and melted (heat and pressurizing step).

Then, the medium 11 and the fixing belt 41 are carried to the release roll 45 while the medium 11 and the fixing belt 41 come into contact with each other through the melted toner layer. During the conveyance, the fixing belt 41, the transparent toner image, the color toner images and the medium 11 are cooled by the heat sink 47 (cooling step).

Accordingly, when the medium 11 reaches the release roll 45, the transparent toner image, the color toner images and the medium 11 are collectively released from the fixing belt 41 on the basis of the curvature of the release roll 45 (releasing step).

In this manner, a high glossy color image is formed on the medium 11.

Embodiment 4

An image-forming system according to this embodiment uses an ink jet method.

A surface of an ink jet image directly reflects a surface of a medium 11 itself.

Therefore, the requirement in the ink jet method is that a medium 11 satisfying the optical reflection characteristics (1) to (3) is prepared.

Figure 9A:
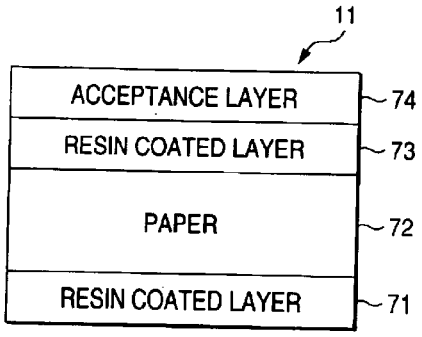
FIGS. 9A and 9B are explanatory views showing the medium for Embodiment 4 according to the invention.

In the case of a printing paper base (having a resin coat layer 71, a paper layer-72, a resin coat layer 73 and an acceptance layer 74) as shown in FIG. 9A, the factor for deciding the surface of the medium 11 reflects the surface property of the paper layer 72 itself, the thickness of the resin coat layer 71 (and/or the resin coat layer 73) and the physical property of the acceptance layer 74.

In this case, it is difficult to satisfy the requirement (2) though the requirements (1) and (3) of the optical reflection characteristics can be satisfied by a method such as a method of smoothening the surface of the paper layer 72, a method of thickening the resin coat layer 71 (or 73), a method of thickening the acceptance layer 74, a method of reducing the particle size of silica, alumina, or the like in the acceptance layer 74, or a method of reducing the resin content of a film material of the acceptance layer 74.

A filler may be preferably added into the acceptance layer 74 in order to satisfy the requirement (2). From the point of view of color reproduction, it is important that the filler is transparent and free from light scattering. To obtain the transparency and scattering-free property, the filler size is preferably reduced or the refractive index difference between the filler and the resin component constituting the acceptance layer 74 is preferably reduced. It is however impossible to satisfy the requirement (2) even in the case where the filler size is merely reduced.

As a preferred unit for satisfying the requirement (2), a surface shape control unit such as a calendering unit may be provided in a coater for applying the acceptance layer 74. In this case, after the acceptance layer 74 is applied, the acceptance layer 74 is pressed by a roll or the like so that the shape of a surface of the roll is transferred onto the surface of the acceptance layer 74. The surface of the roll may be polished or buffed in advance to satisfy the requirements (1) to (3).

Figure 9B:
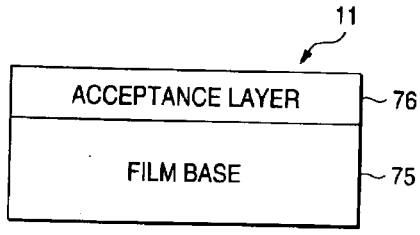

On the other hand, in the case of a printing paper base constituted by a film base 75 of Polyethylene Terephthalate (PET) or the like as shown in FIG. 9B, it is difficult to satisfy the requirement (2) through the requirements (1) and (3) can be satisfied when the particle size of silica, alumina or the like in the acceptance layer 76 is reduced while a film having smooth surfaces is used.

In this case, the same treatment as in FIG. 9A may be applied in order to satisfy the requirement (2).

Embodiment 5

An image-forming system according to this embodiment uses silver halide photography.

A surface of a silver halide photographic image also directly reflects a surface of a printing paper medium 11 itself.

Therefore, the requirement in the silver halide photography is that a printing paper medium 11 satisfying the optical reflection characteristics (1) to (3) is prepared.

Figure 10:
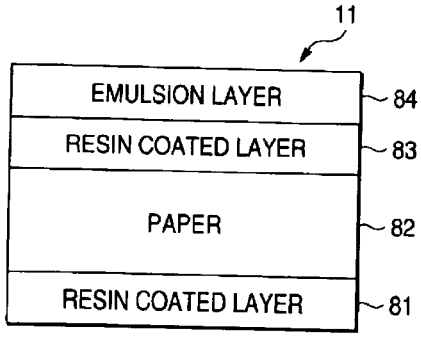
FIG. 10 is an explanatory view showing the medium for Embodiment 5 according to the invention.

In the case of a printing paper base (having a resin coat layer 81, a paper layer 82, a resin coat layer 83 and a gelatin emulsion layer 84) as shown in FIG. 10, the factor for deciding the surface of the medium 11 reflects the surface property of the paper layer 82 itself, the thickness of the resin coat layer 81 (and/or the resin coat layer 83) and the physical property of the emulsion layer 84.

In this case, it is difficult to satisfy the requirement (2) though the requirements (1) and (3) of the optical reflection characteristics can be satisfied by a method such as a method of smoothening the surface of the paper layer 82, a method of thickening the resin coat layer 81 (or 83), a method of thickening the emulsion layer 84 or a method of reducing the resin content of the emulsion layer 84.

A filler may be preferably added into the emulsion layer 84 in order to satisfy the requirement (2). From the point of view of color reproduction, it is important that the filler is transparent and free from light scattering. To obtain the transparency and scattering-free property, the filler size is preferably reduced or the refractive index difference between the filler and the resin component constituting the emulsion layer 84 is preferably reduced. It is however impossible to satisfy the requirement (2) even in the case where the filler size is merely reduced.

As a preferred unit for satisfying the requirement (2), a surface shape control unit such as a calendering unit may be provided in a coater for applying the emulsion layer 84. In this case, after the emulsion layer 84 is applied, the emulsion layer 84 is pressed by a roll or the like so that the shape of a surface of the roll is transferred onto the surface of the emulsion layer 84. The surface of the roll may be polished or buffed in advance to satisfy the requirements (1) to (3).

EXAMPLES

Models according to the embodiments of the invention will be described more specifically by way of example.

Example 1

Color Toner Developers

A cyan development unit, a magenta development unit, a yellow development unit and a black development unit for A Color made by FUJI XEROX CO., LTD. were used as color toner development unit in the example. The mean particle size, $D_{50}$ of the color toners was 7 $\mu$m.

Transparent Toner

Linear polyester (molar ratio=5:4:1, Tg=62° C., Mn=4, 500, Mw=10,000) obtained from terephthalic acid/bisphenol A ethylene oxide adduct/cyclohexanedimethanol was used as a binder resin. The binder resin was pulverized by a jet mill and then classified by a wind power type classifier to thereby produce transparent fine particles of $d_{50}$=11 $\mu$m The following two kinds of inorganic fine particles A and B were deposited on 100 parts by weight of the transparent fine particles by a high-speed mixing machine.

The inorganic fine particles A were made of $SiO_2$ (surface-treated with a silane coupling agent to be made hydrophobic and having a mean particle size of 0.05 $\mu$m). The amount of the inorganic fine particles A added was 1.0 part by weight. The inorganic fine particles B were made of $TiO_2$ (surface-treated with a silane coupling agent to be made hydrophobic and having a mean particle size of 0.02 $\mu$m and a refractive index of 2.5). The amount of the inorganic fine particles B added was 1.0 part by weight.

The toner was mixed with the same carrier as that of the black development unit serving as a color toner to thereby produce a two-component development unit.

Color Image-Forming System (Image-Creating Unit)

A color image-forming system shown in FIG. 7 was used as an image-forming system. The speed of the image-forming process except the fixing step was 160 mm/sec. The toner/carrier weight ratio, the potential of the charged photoconductor drum 31, the amount of exposure and the developing bias voltage were adjusted so that the amount of the developed toner in each color became 0.5 mg/cm$^2$ when the level of the image signal was set at 100%.

Medium

Never Tear Paper (Polyethylene Terephthalate (PET) medium containing a white pigment dispersed therein, made by XEROX CORPORATION) was used as the medium 11 used for forming a color image.

Development of Transparent Toner

A two-component development unit was used as the transparent toner image development unit 65. The toner/carrier weight ratio, the potential of the charged photoconductor drum 31, the amount of exposure and the developing bias voltage were adjusted so that the amount of the developed transparent toner became 1.5 mg/cm$^2$.

Fixing Unit An 80 $\mu$m-thick polyimide film containing electrically conductive carbon dispersed therein was coated with 50 μ-thick KE4895 silicone rubber (made by SHIN-ETSU CHEMICAL CO., LTD.). This resulting film was used as the fixing belt 41.

Two rolls each having an aluminum core, and a 2 mm-thick silicone rubber layer provided on the aluminum core were used as the heat roll 42 and the pressure roll 46 respectively. A halogen lamp was placed as a heat source in each of the two rolls 42 and 46. The surface temperature of each of the rolls 42 and 46 was adjusted to be 175° C.

The fixing speed was set at 30 mm/sec.

The temperature of the medium 11 in the release position was 70° C.

The method of evaluating the obtained image will be described below.

(Subjective Evaluation of Surface Quality)

An image to be evaluated was produced from a portrait photograph as an original image. The surface quality of the image was subjectively evaluated in accordance with visual observation by twenty persons under a desktop fluorescent lamp and classified into the following five category.

1: very poor

2: poor

3: neither good nor poor

4: good

5: very good

Then, the obtained average of the category values was evaluated according to the following criteria.

XX: the case where the average was smaller than 2.5

X: the case where the average was not smaller than 2.5 but smaller than 3.5

○: the case where the average was not smaller than 3.5

The toner materials used were evaluated as follows.

Molecular weight was measured by gel permeation chromatography. Tetrahydrofuran was used as a solvent.

The mean particle size of each toner was measured in terms of weight-average particle size $d_{50}$ by a coulter counter.

EXAMPLE 2

A color image was produced in the same manner as in Example 1 except that the image-forming system is placed by an image-forming system shown in FIG. 5.

EXAMPLE 3

A color image was produced in the same manner as in Example 1 except that the medium used for forming the color image was replaced by a medium produced by the following procedure.

Method for Production of Medium

A 30 μm-thick diffuse reflection layer containing 30 parts by weight of titanium oxide mixed with 100 parts by weight of a polyethylene resin was laminated on a front surface of a 150 μm-thick raw paper sheet made of a pulp material. A 30 μm-thick polyethylene resin was laminated on a rear surface of the raw paper sheet and colloidal silica was further coated as an antistatic agent on the polyethylene resin.

Comparative Example 1

An unfixed color toner image was transferred onto a medium by the same system as in Example 1. The medium was placed on the conveyer unit and a transparent toner image was provided on the color toner image by the same system as in Example 1. Incidentally, silicone rubber as the belt material applied on the surface of the fixing belt 41 was replaced by DY35-796C (made by TORAY INDUSTRIES, INC.)

Comparative Example 2

A color image was produced in the same system as in Example 1 except that the medium was replaced by OK super art paper (made by OJI SEISHI CO. LTD.).

Comparative Example 3

The same original image as in Example 1 was used so that a reflection print was produced by a silver halide photography type printer PictroGraphy 3000 (made by FUJI PHOTO FILM CO., LTD.)

Comparative Example 4

The same original image as in Example 1 was used so that a reflection print was produced on a PM photographic paper sheet (made by SEIKO EPSON CORPORATION) by an ink jet type printer PM-900 (made by SEIKO EPSON CORPORATION).

Comparative Example 5

The same original image as in Example 1 was used so that a reflection print was produced on Professional Photo Paper (made by CANON INC.) by an ink jet type printer BJF-870 (made by CANON INC.)

Comparative Example 6

A laminator for PictroGraphy was used so that a transparent PET film was laminated on the image obtained in Comparative Example 4.

Comparative Example 7

A laminator for PictroGraphy was used so that a transparent PET film was laminated on the image obtained in Example 1.

FIG. 11 shows results of the evaluation.

It will be understood from FIG. 11 that Examples 1 to 3 are superior in subjective surface quality to Comparative Examples 1 to 7. It will be also understood from FIG. 11 that the evaluation values of the optical reflection characteristics (1) to (3) in each of Examples 1 to 3 are in proper ranges respectively.

As described above, in accordance with the invention, an image structure, for example, of a digital photographic printing image is formed to have predetermined optical reflection characteristics. Hence, the image structure can be provided as an image structure which is smooth, high glossy and preferable in surface quality so that flaws or waviness is inconspicuous.

In addition, the image structure having such a preferable surface quality can be formed easily and surely by an image-forming system according to the invention.

What is claimed is:

1. An image structure, comprising:

a medium; and an image formed on the medium; wherein the image is formed so that an angular distribution of surface reflection light beams under a condition that a surface of the image is irradiated with a slit-transmitted light beam satisfies the following three characteristics:

(1) an angle A corresponding to a half value of a reflected light peak is not smaller than unity but not larger than twice as large as an angle A0 corresponding to a half value of a reflected light peak of surface reflection light beams under a condition that a surface of a gloss standard glass plate (Gloss 96.8, made by MURAKAMI COLOR RESEARCH LABORATORY) is irradiated with a slit-transmitted light beam;

(2) $\Delta X_G WS/\Delta X_G WS0$ is not larger than 10 when $\Delta X_G WS$ is an integrated value (WS of center-of-gravity fluctuation) after the X coordinate $X_G$ of the center of gravity in each Y position is calculated in an X-Y coordinate system having an X axis in a direction corresponding to a width of a slit and a Y axis in a direction corresponding to a length of the slit and is multiplied by a frequency response function of vision on the basis of frequency analysis of a locus of the X coordinate $X_G$ of the center of gravity in the Y direction, and $\Delta X_G WS0$ is a reference value obtained by calculation of WS of center-of-gravity fluctuation of the gloss standard glass plate (Gloss 96.8, made by MURAKAMI COLOR RESEARCH LABORATORY) in the same manner as described above; and (3) an angle B at which a quantity of reflected light becomes 1/10 as large as the peak value is in a range of from 3×A0 to 6×A0, both inclusively.

2. The image structure according to claim 1, wherein the image is a digital photographic printing image including a layer of color toners and a transparent toner layer;

the medium includes a diffuse reflection layer at least containing a white pigment and a thermoplastic resin;

the color toner layer and the transparent toner layer are laminated on the medium; and the transparent toner layer is formed as the uppermost layer.

3. The image structure according to claim 2, wherein:

the medium at least has a raw paper sheet made of a pulp material;

the diffuse reflection layer is laminated on the raw paper sheet;

the diffuse reflection layer contains at least a polyethylene resin as the thermoplastic resin and titanium oxide particles dispersed as the white pigment in the polyethylene resin; and the transparent toner layer includes a polyester resin.

4. The image structure according to claim 2, wherein:

the diffuse reflection layer contains a polyethylene trephthalate resin and a white pigment dispersed into the polyethylene trephthalate resin; and the transparent toner layer includes a polyester resin.

5. An image structure, comprising:

an image formed on a medium; wherein the image is formed so that an angular distribution of surface reflection light beams under a condition that a surface of the image is irradiated with a slit-transmitted light beam satisfies the following three characteristics:

(1) an angle A corresponding to a half value of a reflected light peak is not smaller than unity but not larger than twice as large as an angle A0 corresponding to a half value of a reflected light peak of surface reflection light beams under a condition that a surface of a gloss standard glass plate (Gloss 96.8, made by MURAKAMI COLOR RESEARCH LABORATORY) is irradiated with a slit-transmitted light beam;

(2) $\Delta X_G WS/\Delta X_G WS0$ is not larger than 10 when $\Delta X_G WS$ is an integrated value (WS of center-of-gravity fluctuation) after the X coordinate $X_G$ of the center of gravity in each Y position is calculated in an X-Y coordinate system having an X axis in a direction corresponding to a width of a slit and a Y axis in a direction corresponding to a length of the slit and is multiplied by a frequency response function of vision on the basis of frequency analysis of a locus of the X coordinate $X_G$ of the center of gravity in the Y direction, and $\Delta X_G WS0$ is a reference value obtained by calculation of WS of center-of-gravity fluctuation of the gloss standard glass plate (Gloss 96.8, made by MURAKAMI COLOR RESEARCH LABORATORY) in the same manner as described above; and (3) an angle B at which a quantity of reflected light becomes 1/10 as large as the peak value is in a range of from 3×A0 to 6×A0, both inclusively.

6. An image-forming system, comprising:

an image-creating unit for forming an image on a medium; wherein the image-creating unit sets at least a surface of the medium to give the image on the medium; and the image is formed so that an angular distribution of surface reflection light beams under a condition that a surface of the image is irradiated with a slit-transmitted light beam satisfies the following three characteristics:

(1) an angle A corresponding to a half value of a reflected light peak is not smaller than unity but not larger than twice as large as an angle A0 corresponding to a half value of a reflected light peak of surface reflection light beams under a condition that a surface of a gloss standard glass plate (Gloss 96.8, made by MURAKAMI COLOR RESEARCH LABORATORY) is irradiated with a slit-transmitted light beam;

(2) $\Delta X_G WS/\Delta X_G WS0$ is not larger than 10 when $\Delta X_G WS$ is an integrated value (WS of center-of-gravity fluctuation) after the X coordinate $X_G$ of the center of gravity in each Y position is calculated in an X-Y coordinate system having an X axis in a direction corresponding to a width of a slit and a Y axis in a direction corresponding to a length of the slit and is multiplied by a frequency response function of vision on the basis of frequency analysis of a locus of the X coordinate $X_G$ of the center of gravity in the Y direction, and $\Delta X_G WS0$ is a reference value obtained by calculation of WS of center-of-gravity fluctuation of the gloss standard glass plate (Gloss 96.8, made by MURAKAMI COLOR RESEARCH LABORATORY) in the same manner as described above; and (3) an angle B at which a quantity of reflected light becomes 1/10 as large as the peak value is in a range of from 3×A0 to 6×A0, both inclusively.

7. The image-forming system according to claim 6, wherein viscosity of a transparent toner used is in a range of from $10^2$ Pa·s to $5\times10^3$ Pa·s at a toner layer temperature in a fixing process.

8. An image-forming system, comprising:

an image-creating unit for forming an image on a medium; and a fixing unit for fixing the image formed by the image-creating unit on the medium;

wherein:

the fixing unit has a fixing member brought into close contact with the image on the medium so that the image is sandwiched between the fixing member and the medium;

surfaces of the fixing member and the medium are set in order to give the image on the medium;

the image is a digital photographic printing image including a color toner layer and a transparent toner layer;

the medium includes a diffuse reflection layer at least containing a white pigment and a thermoplastic resin;

the color toner layer and the transparent toner layer are laminated on the medium;

the transparent toner layer is formed as the uppermost layer;

the image is formed so that an angular distribution of surface reflection light beams under a condition that a surface of the image is irradiated with a slit-transmitted light beam satisfies the following three characteristics:

(1) an angle A corresponding to a half value of a reflected light peak is not smaller than unity but not larger than twice as large as an angle A0 corresponding to a half value of a reflected light peak of surface reflection light beams under a condition that a surface of a gloss standard glass plate (Gloss 96.8, made by MURAKAMI COLOR RESEARCH LABORATORY) is irradiated with a slit-transmitted light beam;

(2) $\Delta X_G WS/\Delta X_G WS\mathbf{0}$ is not larger than 10 when $\Delta X_G WS$ is an integrated value (WS of center-of-gravity fluctuation) after the X coordinate $X_G$ of the center of gravity in each Y position is calculated in an X-Y coordinate system having an X axis in a direction corresponding to a width of a slit and a Y axis in a direction corresponding to a length of the slit and is multiplied by a frequency response function of vision on the basis of frequency analysis of a locus of the X coordinate $X_G$ of the center of gravity in the Y direction, and $\Delta X_G WS\mathbf{0}$ is a reference value obtained by calculation of WS of center-of-gravity fluctuation of the gloss standard glass plate (Gloss 96.8, made by MURAKAMI COLOR RESEARCH LABORATORY) in the same manner as described above; and (3) an angle B at which a quantity of reflected light becomes 1/10 as large as the peak value is in a range of from 3×A0 to 6×A0, both inclusively.

9. The image-forming system according to claim 8, wherein the fixing unit has a heating and pressurizing unit for heating and pressurizing the color toner layer and the transparent toner layer on the medium, and a cooling and releasing unit for cooling the heated and pressurized toner layers and releasing the toner layers from the fixing member.

10. The image-forming system according to claim 8, wherein the image-creating unit has an electrostatic transfer unit for electrostatically transferring the color toner layer and the transparent toner layer onto the medium.

11. The image-forming system according to claim 8, wherein:

the image-creating unit has an electrostatic transfer unit for electrostatically transferring the color toner layer onto the medium, and a transparent toner layer-forming unit for forming the transparent toner layer on the fixing member of the fixing unit; and the transparent toner layer is laminated on the color toner layer by a nip portion between the fixing member of the fixing unit and the medium.

12. The image-forming system according to claim 8, wherein the angular distribution of surface reflection light beams under a condition that a surface of the fixing member of the fixing unit is irradiated with a slit-transmitted light beam satisfies the characteristics (1) and (3) defined in claim 8.

13. The image-forming system according to claim 8, wherein the fixing member includes an elastic layer having a hardness of 30 degrees to 60 degrees (Asker C) and a thickness of 20 μm to 50 μm.

14. The image-forming system according to claim 8, wherein a fraction of voids in a portion of the medium except the surface layer is not lower than 50%.

* * * * *